US007471919B2

(12) United States Patent
Kawakami et al.

(10) Patent No.: US 7,471,919 B2
(45) Date of Patent: Dec. 30, 2008

(54) IMAGE FORMING APPARATUS WITH FIRST AND SECOND MOTORS

(75) Inventors: Shinya Kawakami, Mishima (JP); Takashi Sekiguchi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/352,221

(22) Filed: Feb. 13, 2006

(65) Prior Publication Data

US 2006/0188291 A1 Aug. 24, 2006

(30) Foreign Application Priority Data

Feb. 18, 2005 (JP) ..... 2005-042140

(51) Int. Cl.
*G03G 15/00* (2006.01)

(52) U.S. Cl. ..... 399/167; 399/320; 399/328; 399/335; 399/339

(58) Field of Classification Search ..... 399/167, 399/67, 68, 320, 328, 335, 339
See application file for complete search history.

(56) References Cited

U.S. PATENT DOCUMENTS

| | | | | |
|---|---|---|---|---|
| 4,734,868 | A * | 3/1988 | DeLacy | 358/1.12 |
| 5,016,057 | A * | 5/1991 | Nakajima et al. | 399/320 |
| 5,060,025 | A * | 10/1991 | Kummel et al. | 399/401 |
| 6,801,729 | B2 | 10/2004 | Wada et al. | 399/68 |
| 6,942,209 | B2 | 9/2005 | Kawakami | 271/121 |

FOREIGN PATENT DOCUMENTS

| | | |
|---|---|---|
| JP | 63-214554 | 9/1988 |
| JP | 4-44075 | 2/1992 |
| JP | 4-44076 | 2/1992 |
| JP | 4-44077 | 2/1992 |
| JP | 4-44078 | 2/1992 |
| JP | 4-44079 | 2/1992 |
| JP | 4-44080 | 2/1992 |
| JP | 4-44081 | 2/1992 |
| JP | 4-44082 | 2/1992 |
| JP | 4-44083 | 2/1992 |
| JP | 4-204980 | 7/1992 |
| JP | 4-204981 | 7/1992 |
| JP | 4-204982 | 7/1992 |
| JP | 4-204983 | 7/1992 |
| JP | 4-204984 | 7/1992 |
| JP | 2001-199610 | 7/2001 |
| JP | 2004-19757 | 1/2004 |

* cited by examiner

*Primary Examiner*—David M Gray
*Assistant Examiner*—Geoffrey T Evans
(74) *Attorney, Agent, or Firm*—Fitzpatrick, Cella, Harper & Scinto

(57) ABSTRACT

The image forming apparatus includes an image bearing member, a first motor for driving said image bearing member, a fixing unit which fixes an image transferred from said image bearing member to a recording material onto the recording material and a second motor for driving said fixing unit, wherein said fixing unit is started up by said first motor and then driven by said second motor. Thereby, costs on the second motor for driving the fixing apparatus, which is disposed separately from the first motor for driving the image forming apparatus, can be restrained.

8 Claims, 11 Drawing Sheets t1: FIRST MOTOR START-UP TIME
t2: SECOND MOTOR START-UP TIME

IMAGE FORMING APPARATUS WITH FIRST AND SECOND MOTORS

BACKGROUND OF THE INVENTION

1. Field of the Invention

The present invention relates to an image forming apparatus, such as a copier or a printer of forming images onto a recording media and in particular relates to an image forming apparatus having a first motor for driving an image bearing member such as a photosensitive member in particular and a second motor for driving a fixing device.

2. Description of Related Art

Conventionally, in an image forming apparatus such as the electrophotographic type of a printer or the like, some have two elements of driving means as a configuration of driving source of driving each driven portion.

Japanese Patent Application Laid-Open No. 2001-199610 describes an image forming apparatus having image forming means for forming an unfixed image on recording media; a fixing apparatus for allowing the unfixed image to fix by sandwiching and conveying recording media introduced from the above-described image forming means side with a nip formed by a heating member and a pressing member; first driving means (a first motor) for driving the above-described image forming means; and second driving means (a second motor) for driving the above-described fixing apparatus. And, with controlling the driving speed of the second driving means, tension of the recording media from the image forming means side to the fixing apparatus is controlled not to vary, enabling restraining image disorder suitably and maintaining high-grade image quality. Incidentally, the starting torque necessary for starting the fixing device from a halt state is far larger than a necessary stationary torque at the time when the fixing device rotates stationarily. Accordingly, at the time of designing the apparatus, selection of the second motor in conformity of the starting torque of the fixing device will result in selection of a motor generating a large output. However, a motor generating a large output costs high.

SUMMARY OF THE INVENTION

The present invention is attained in consideration of the aforementioned problems and an object thereof is to provide an image forming apparatus that can restrain the cost of the second motor for driving the fixing device.

Another object of the present invention is to provide an image forming apparatus that restrains costs on the second motor and stabilizes start-up of the fixing device.

A further object of the present invention is to provide an image forming apparatus including an image bearing member, a first motor for driving said image bearing member, a fixing unit which fixes an image transferred from said image bearing member to a recording material onto the recording material, and a second motor for driving said fixing unit, wherein said fixing unit is started up by said first motor and then driven by said second motor.

Still further object of the present invention will become apparent by reading the following detailed description with reference to the attached drawings.

DETAILED DESCRIPTION OF THE PREFERRED EMBODIMENTS

The best embodiment of the present invention will be described in detail below with reference to the drawings. However, size, material, shape and relative dispositions and the like of component members applied to those embodiments are not intended to limit the range of this invention to those descriptive items as far as there is no specifying description.

First Embodiment

Figure 1:
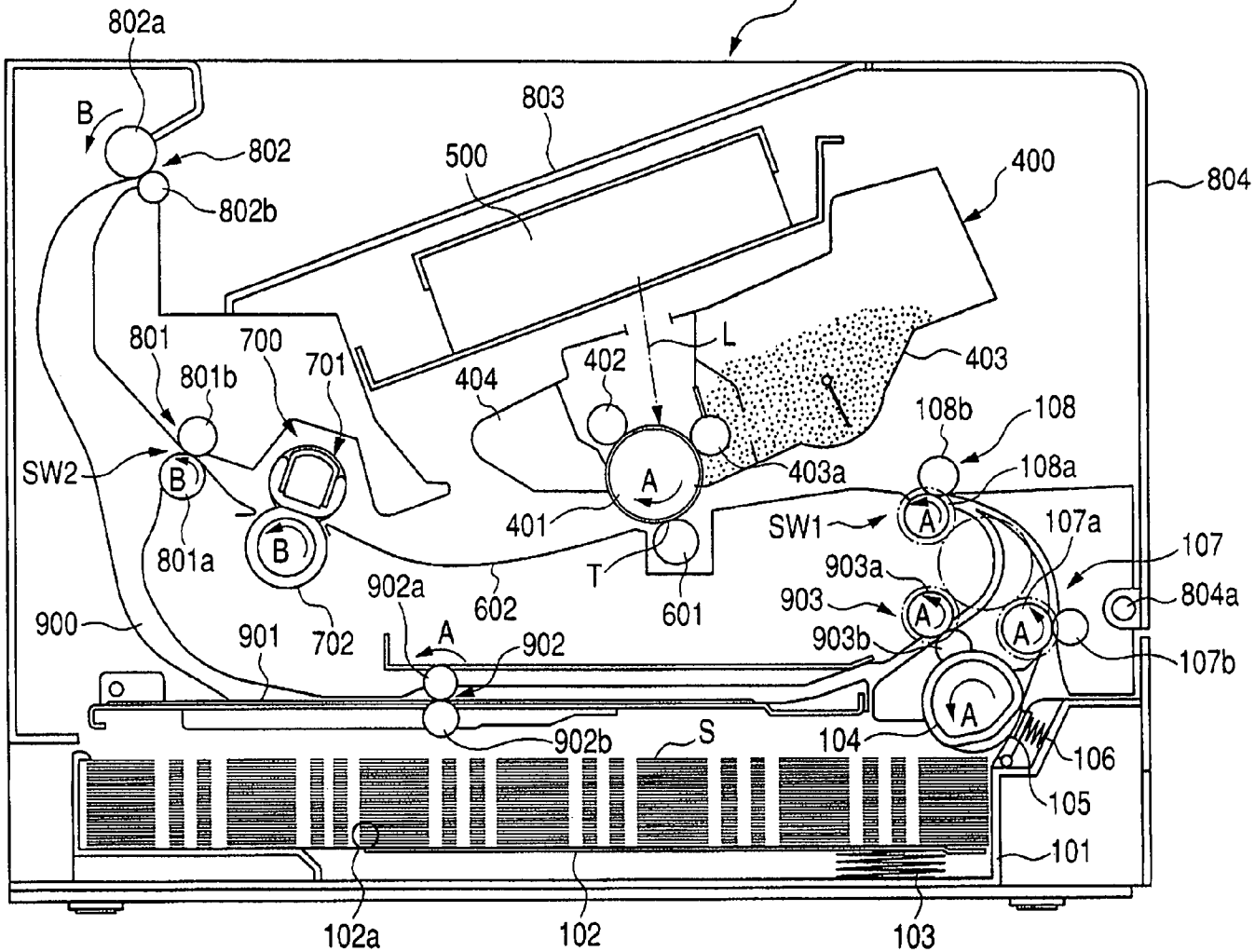
FIG. 1 is a simplified sectional view showing a holistic configuration of an image forming apparatus related to a first embodiment.

FIG. 1 is a schematic configuration model view of an example of an image forming apparatus related to the present invention. The image forming apparatus of the present embodiment is a laser beam printer (LBP) in utilization of a transferring type electrophotographic process.

(1) Holistic Configuration

Figure 2:
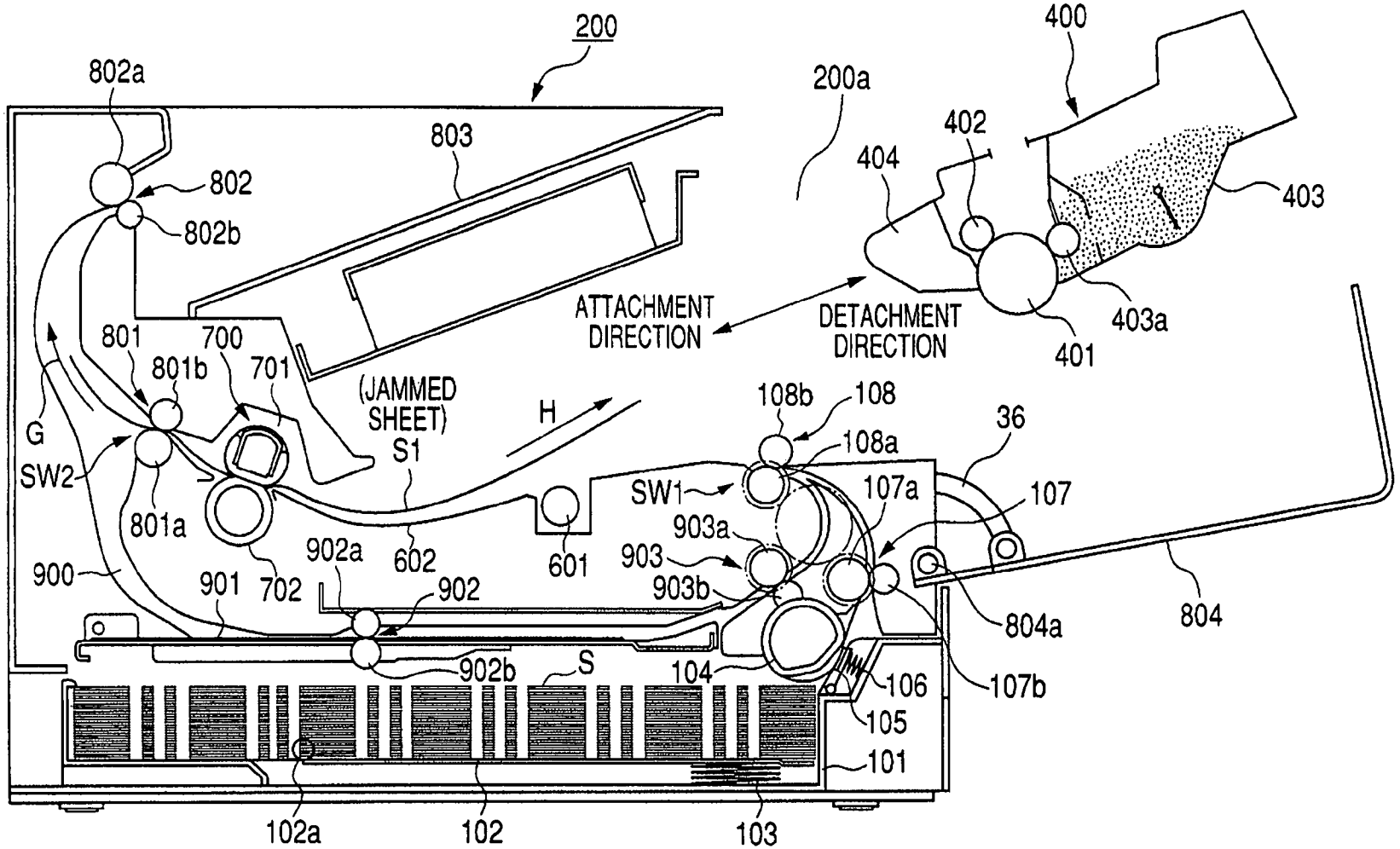
FIG. 2 is a drawing of describing operations at the time of JAM processing in the image forming apparatus.

As shown in FIG. 1, a process unit (process cartridge) 400 is detachably attached to a main body 200 of an image forming apparatus (hereinafter to be referred to as an apparatus main body). The process unit 400 of the present embodiment is caused to include four electrophotographic process appliances of a drum type electrophotographic photosensitive member (hereinafter to be referred to as a photosensitive drum) 401 being an image bearing member, a charging roller (electro-conductive roller) 402 of charging the photosensitive drum; a developing apparatus 403 having a developing roller 403*a* of developing an electrostatic latent image formed onto the photosensitive drum as a toner image; a cleaning device (cleaner) 404 of cleaning the photosensitive drum surface. As shown in FIG. 2, this process unit 400 can be attached to or detached from the apparatus main body 200 through an opening portion 200*a* to which an interior of the apparatus main body 200 is opened up by opening a door member 804 which is openable/closable about a hinge portion 804*a* with regard to the apparatus main body 200. FIG. 1 shows a state which the process unit 400 is attached to the apparatus main body 200 in a predetermined condition and the door member 804 is closed.

The photosensitive drum 401 is rotary-driven at a predetermined speed clockwise to an arrow A in FIG. 1 so that its surface is processed to be uniformly charged to a predetermined polarity/potential with the charging roller 402. Laser scanning exposure L is undergone on the charging processing surface of the photosensitive drum 401 with a laser scanner unit 500. The laser scanner unit 500 outputs a laser beam subject to modulation corresponding with electrodigital pixel signals of image information transmitted from a host computer (not shown in the drawing) to cause the charging processing surface of the photosensitive drum 401 to undergo scanning and exposure. Thereby an electrostatic latent image corresponding with an image information pattern subject to scanning and exposure is formed. Subsequently, that electrostatic latent image is developed with a developing roller 403*a* of the developing apparatus 403 as a toner image.

A paper feeding cassette 101 having a great number of sheets of recording paper S as recording media (recording material) to be compiled and housed is disposed at the bottom inside the apparatus main body 200. The recording paper S is piled on an intermediate plate 102 that is freely rotatable upward and downward on the supporting point 102*a* as center in the paper feeding cassette 101 and is pushed and urged upward by a coil spring 103. On the upside of the paper feeding cassette 101 a paper feeding roller 104 is provided and is driven to rotate once counter-clockwise like an arrow A at a predetermined paper feeding control timing. Rotation of this paper feeding roller 104 applies a feeding power to the recording paper on the top position of the compiled and housed recording paper S inside the paper feeding cassette 101, and a sheet of that recording paper is separated by the separating pad 105 that is pushed in the direction of the paper feeding roller by the spring 106 and is sent out of the interior of the paper feeding cassette 101.

That recording paper S is conveyed by relay by a pair of conveying rollers 107 (reference numeral 107*a* denotes a roller on the drive side while reference numeral 107*b* denotes a pinch roller) to reach a pair of registration rollers 108 (reference numeral 108*a* denotes a roller on the drive side while reference numeral 108*b* denotes a pinch roller) Once the pair of registration rollers 108 receives the front tip of the recording paper S with a nip portion in a rotation halt state, they correct skewing of the recording paper. Thereafter they are rotary driven at predetermined control timing and thereby convey and guide the recording paper S to the transfer nip portion T being a contact portion between the photosensitive drum 401 and the transfer roller 601. With regard to the direction of the recording paper S to be conveyed, a registration sensor SW1 of detecting whether or not the front tip of the recording paper S conveyed with the pair of registration rollers 108 is passing is disposed downstream from the pair of registration rollers 108. The recording paper S is sandwiched and conveyed by the transfer nip portion T and meanwhile undergoes application of a transfer bias of predetermined potential with the opposite polarity to the charging polarity of toner from a transfer bias power supply (not shown in the drawing) to the transfer roller 601. Thereby, the surface of the recording paper S is sequentially going through electrostatic transfer of a toner image on the side of the photosensitive drum 401. The recording paper S having undergone transfer of the toner image goes out of the transfer nip portion T and then is separated from the surface of the photosensitive drum 401 to pass through the conveyance path 602 and is guided to the fixing unit 700 as fixing apparatus. As to be described later, the fixing unit 700 sandwiches and conveys the recording paper S with the fixing nip portion N to bring the unfixed toner image into heat pressure fixing onto the surface of the recording paper S as eternally stuck image.

The recording paper S that has got out of the fixing nip portion N of the fixing unit 700 is conveyed by relay by a pair of intermediate discharging rollers 801 consisting of a drive side roller 801*a* and a pinch roller 801*b* to reach a pair of discharging rollers 802 consisting of a drive side roller 802*a* and a pinch roller 802*b*. It is discharged as image formed product (for example, a print and a photocopy) onto the discharging tray 803 on the top plane of the apparatus main body 200.

The printer of the present embodiment comprises a duplex unit capable of executing automatic duplex print onto the recording paper S. In the case where that automatic duplex print mode is selected, detection by the sheet sensor SW2 disposed on the recording paper exit side of the nip portion on an event that the trailing edge of the recording paper S having undergone one-side print (having undergone image forming onto the first side) has got through out of the nip portion of the pair of intermediate discharging rollers 801 is followed by switching of rotation of the pair of discharging rollers 802 to inverse rotary drive (rotation in the direction opposite to the direction of an arrow B indicative of the rotation so far). Thereby, the recording paper S having undergone one-side print is conveyed downward along a reverse conveyance path 900 in a condition wherein the trailing edge of the recording paper S moves in front, via a duplex conveyance path 901 and a pair of duplex conveying rollers 902 consisting of the drive side roller 902*a* and the pinch roller 902*b* until it reaches a pair of duplex paper refeeding rollers 903 consisting of the drive side roller 903*a* and the pinch roller 903*b*. And again, it is conveyed to enter the transfer nip portion T through the pair of registration rollers 108. In this case, the recording paper S has its front surface side and back surface side reversed so that the second side faces the photosensitive drum 401 side and a toner image undergoes electrostatic transfer onto this second side. Hereafter, likewise the image forming on the first side, the recording paper S is conveyed along the route of the conveyance path 602, the fixing unit 700, the pair of intermediate discharging rollers 801 and the pair of discharging rollers 802 and is discharged onto discharging tray 803 as image formed product having undergone duplex print.

(2) Fixing Unit 700

Figure 3:
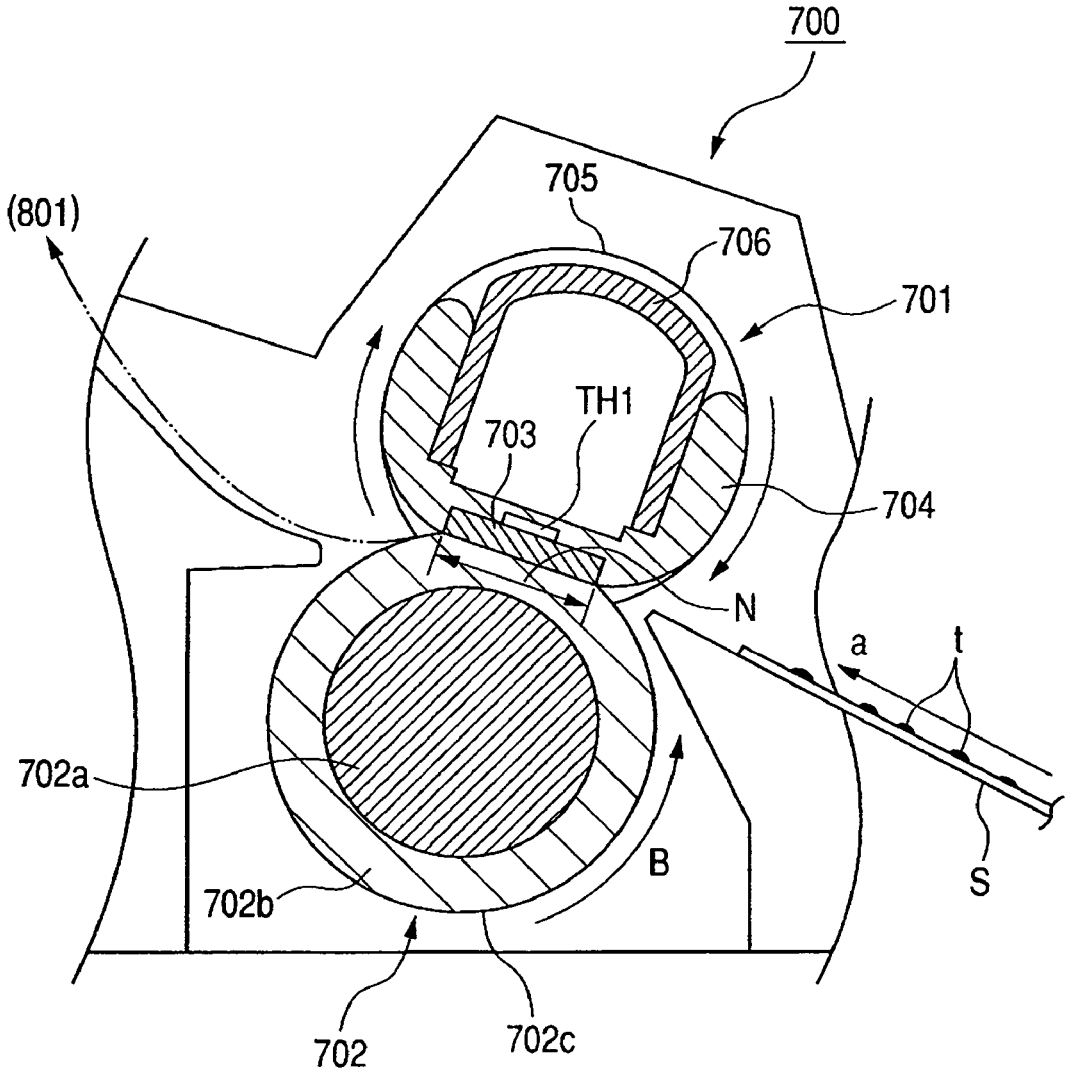
FIG. 3 is an enlarged cross-sectional model view of a fixing unit.

FIG. 3 is an enlarged cross-sectional model view of a fixing unit 700. The fixing unit 700 in the present embodiment is a heating apparatus in a film heating system of a pressure roller drive system/tensionless type that is disclosed in Japanese Patent Application Laid-Open Nos. H04-044075, H04-044076, H04-044077, H04-044078, H04-044079, H04-044080, H04-044081, H04-044082 and H04-044083, and Japanese Patent Application Laid-Open Nos. H04-204980, H04-204981, H04-204982, H04-204983 and H04-204984.

A film unit 701 and an elastic pressure roller 702 are arranged in an upward and downward direction in parallel and disposed to bring the mutual surfaces into pressure contact to form a fixing nip portion N between the both parties.

Inside the film unit 701, disposed is a stay 704 that gives rise to an effect as guiding member which is made of a material such as highly heat resisting resin and the like having heat insulation, high heat resistance and rigidity and guides a heating body supporting member as well as the film interior surface. This stay 704 is shaped into substantially semicircular gutter in cross-section and is a longitudinal member with the direction perpendicular to the drawing as longitudinal direction. A heating body (hereinafter to be referred to as heater) 703 is caused to fit into a groove portion provided in the stay 704 along its longitudinal direction on the back surface and is caused to be retained. Reinforcing sheet metal 706 shaped into inverse letter U in cross-section is caused to fit into the gutter type groove portion on the interior side of the stay 704. The stay 704 as well as the reinforcing sheet metal 706 is taken in, on their exterior side, by cylindrical film (hereinafter to be referred to as fixing film) 705 as flexible member (flexible sleeve) that is excellent in heat insulation. The fixing film 705 is brought into fitting loosely from outside over the assembly of the stay 704, the heater 703 and the reinforcing sheet metal 706. That is, the inner circumference length of the fixing film 705 is designed to be larger than the outer circumference length of the stay 704 containing the heater 703 and the reinforcing sheet metal 706. Accordingly, the fixing film 705 is fitting into the stay 704 loosely from outside so as to provide the circumference length with allowance. The fixing film 705 is a thin film cylinder with the base layer made of, for example, polyimide with thickness of around 30 to 100 μm, and PFA, PTFE and the like is coated over the base layer to sandwich a primer layer in between, retaining a mold-releasing property from a toner image. The fixing film 705 may be a flexible cylinder body in a composite layer configuration having a metal cylinder body and a metal layer.

And onto the back surface of the heater 703 on the side of the above-described film unit 701, the elastic pressure roller 702 binds to give pressure the fixing film 705 with pressure means (not shown in the drawing) at predetermined pressure power against the elastic pressure roller 702 so that the fixing nip portion N is formed with a predetermined width required for heat fixing. The reinforcing sheet metal 706 on the above described film unit 701 side prevents the stay 704 and the heater 703 from deformation at the time when pressure is applied by the pressure roller 702.

The pressure roller 702 is configured by a metal shaft 702*a*, an elastic layer 702*b* made of silicon rubber and a mold-releasing layer 702*c* made of FEP, PFA and the like having thickness of around 10 to 100 μm, sandwiching a primer layer over the elastic layer 22*b*.

And, the pressure roller 702 is rotary driven at a predetermined circumferential velocity in the counter-clockwise direction of an arrow B being the recording material conveying direction by a drive configuration to be described later (pressure roller drive system). Accompanied by rotary drive of this pressure roller 702, friction force in the fixing nip portion N between the pressure roller 702 and the fixing film 705 operates to impart rotary force to the cylindrical fixing film 705 so that the fixing film 705, the interior surface of which is sliding around the stay 704 in the fixing nip portion N in tight contact to the downward surface of the heater 703, is driven to rotate in the clockwise direction of the arrow.

The pressure roller 702 rotates to rotate the fixing film 705, and as described later, in a state where conduction to the heater 703 increases temperature of the heater 703 to implement temperature conditioning to a predetermined target temperature, the recording paper S bearing the unfixed toner image t is guided in the fixing nip portion N between the fixing film 705 and the pressure roller 702. And the toner image bearing side of the recording paper passes the fixing nip portion N together with the fixing film 705 in tight contact to the exterior surface of the fixing film 705 and thereby heat of the heater 703 is given to the recording paper S through the fixing film 705 so that the unfixed toner image t undergoes heat fixing onto the surface of the recording paper S. The recording paper S having passed through the fixing nip portion N undergoes curvature separation from the surface of the fixing film 705 and is conveyed for discharge.

Figures 4A, 4B, 4C:
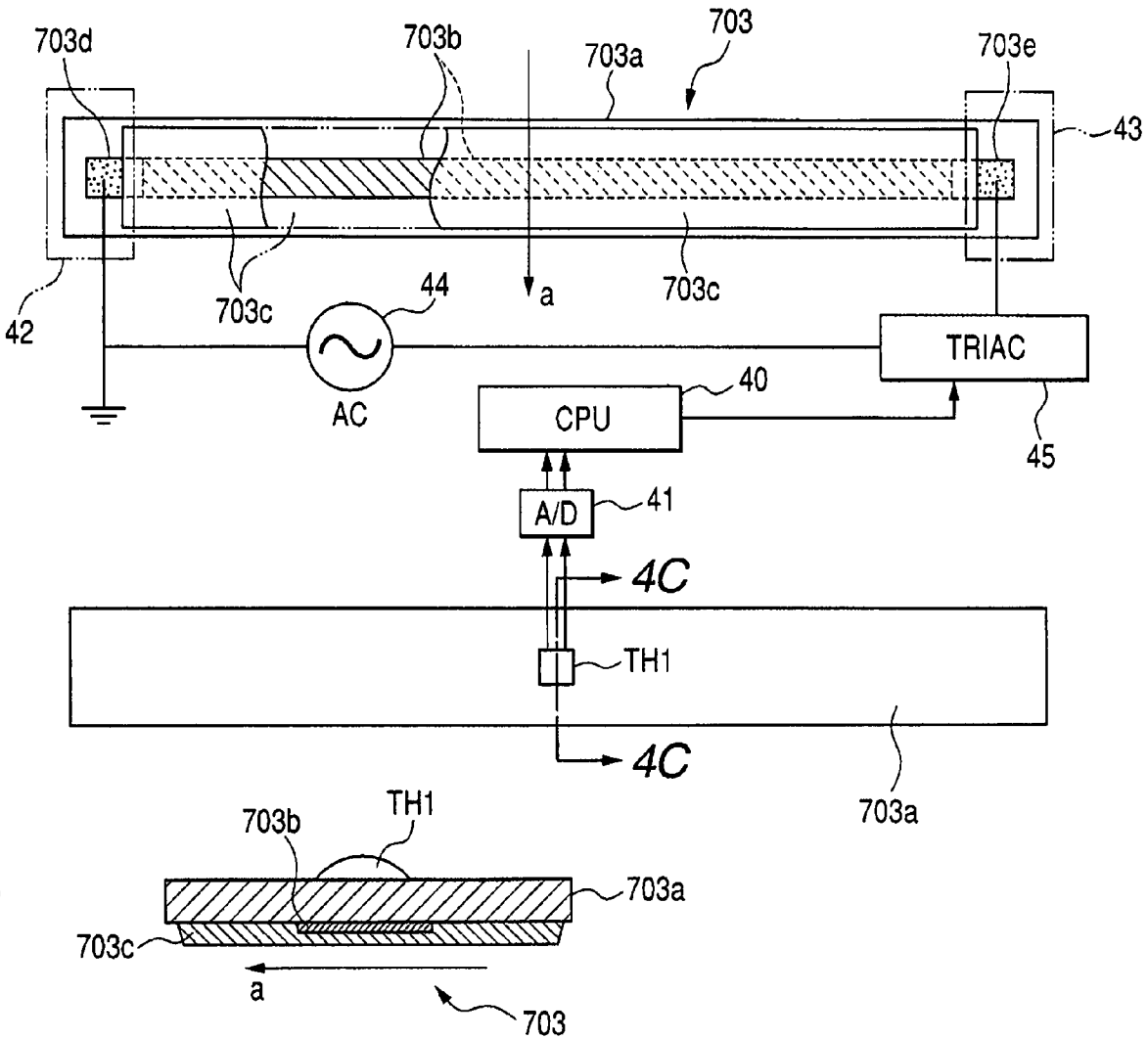
FIG. 4A is a configuration-describing diagram of a heater and a conduction controlling circuit viewed from the front surface side of the heater in a fixing apparatus.
FIG. 4B is a configuration-describing diagram of a heater and a conduction controlling circuit viewed from the rear side of the heater in a fixing apparatus.
FIG. 4C is a sectional view of showing a section in the section 4C-4C in FIG. 4B.

FIGS. 4A, 4B and 4C are configuration-describing diagrams of a heater 703 and a conduction controlling circuit in the present embodiment.

The heater 703 is with low heat capacity in its entirety and consists of a thin and long, heat resistant, insulating and well heat conductive substrate 703*a* with its longitudinal part in the direction perpendicular to the conveying direction a of the recording paper S as material to be heated; a heat generating resistor 703*b* brought into forming and provision along the substrate's longitudinal direction on the substrate's front surface (fixing film sliding surface) side; a heat resisting overcoat layer 703*c* caused to protect the heater surface having formed this heat generating resistor; and power supplying electrodes 703*d* and 703*e* at the longitudinal tip portions of the heat generating resistor 703*b* and the like.

For the substrate 703*a*, ceramic material selected from the group consisting of, for example, alumina, aluminum nitride and the like is used.

The heat generating resistor 703*b* has been derived by bringing, for example, silver, palladium, glass powder (inorganic tying agent), and organic tying agent into kneading and blending to form paste into a slip shape onto the substrate 703*a* with screen print. As material for the heat generating resistor, electric resistant material selected from the group consisting of $RuO_2$, $Ta_2N$ and the like beside silver palladium (Ag/Pd) may be used.

For the power supplying electrodes 703*d* and 703*e*, a screen printed pattern made of silver palladium was used.

The principal object of the overcoat layer 703*c* is to secure an electrical insulating property between the heat generating resistor 703*b* and the fixing film 705 and a sliding property to the fixing film 705. The overcoat layer 703*c* is, for example, a heat resisting glass layer with thickness of approximately 50 μm.

The temperature checking element TH provided for detecting temperature of the heater 703 is disposed on the surface (rear surface side) on the opposite surface side to the side (front surface side) provided with the heat generating resistor 703*b* of the substrate 703*a* of the heater. In the present embodiment, a thermistor is used as this temperature checking element TH. This thermistor TH is provided inside the smallest paper passing range where recording paper in the smallest size usable to the apparatus passes and is connected to the controlling portion (CPU) 40 through an A/D converter 41.

This heater 703 is retained on the downward side of the stay 704, having the overcoat layer 703*c* formed and provided with its front surface side exposed downward.

Power supplying connectors 42 and 43 are fit and attached to the power supplying electrodes 703*d* and 703*e* of the heater 703 that the stay 704 has been made to fix and support and electric contact points on the respective connectors 42 and 43 sides will be in a state of contact with a power supplying electrodes 703*d* and 703*e*. The heater 703 undergoes power supplying between the power supplying electrodes 703*d* and 703*e* from a commercial power supply (AC power supply) 44 through a triac 45 and thereby causes the heat generating resistor 703*b* to generate heat across its longitudinal entire length to give rise to prompt and steep temperature rising. That temperature rise is detected by the thermistor TH so that an output of the thermistor TH undergoes A/D conversion and is taken in to a control portion 40. Based on that information, the control portion 40 controls, with phase control or wave counting control and the like, the power that the triac 45 dispatches power to the heat generating resistor 703*b* to control the heater 703 to be kept at a predetermined temperature.

Here, in consideration of improvement in abrasion resistance, stable rotation of the fixing film 705, uniform heat transfer to the fixing film 705 and the like, heat-resistant grease is coated onto the sliding surface of the heater 703 and the fixing film 705. However, at the time when the fixing unit 700 is cool, viscosity of the above described heat-resistant grease is kept intensive and will act as sliding resistance against the fixing film 705. In addition, also in the pressure roller 702, deformation will take place in the nip portion between itself and the fixing roller 701 in a halt state. They will mainly become a cause of increasing rotation torque at the time of starting the fixing unit 700.

The relationship between starting torque T1 required in order to start and rotate the fixing unit 700 from the halt state and the stationary torque T2 required to bring the fixing unit 700 into stationary rotation will be described as below.

$$T1 \gg T2$$

$$T1 = \alpha \times T2$$

The coefficient α depends on circumferential velocity, nip pressure, pressure roller hardness, heater temperature, stay shape and the like of the fixing unit 700.

In addition, in general the above described coefficient α tends to get larger in a fixing apparatus in the above described film heating system compared with a fixing apparatus in a heat roller system.

(3) Drive Configuration of Image Forming Apparatus

Figure 5:
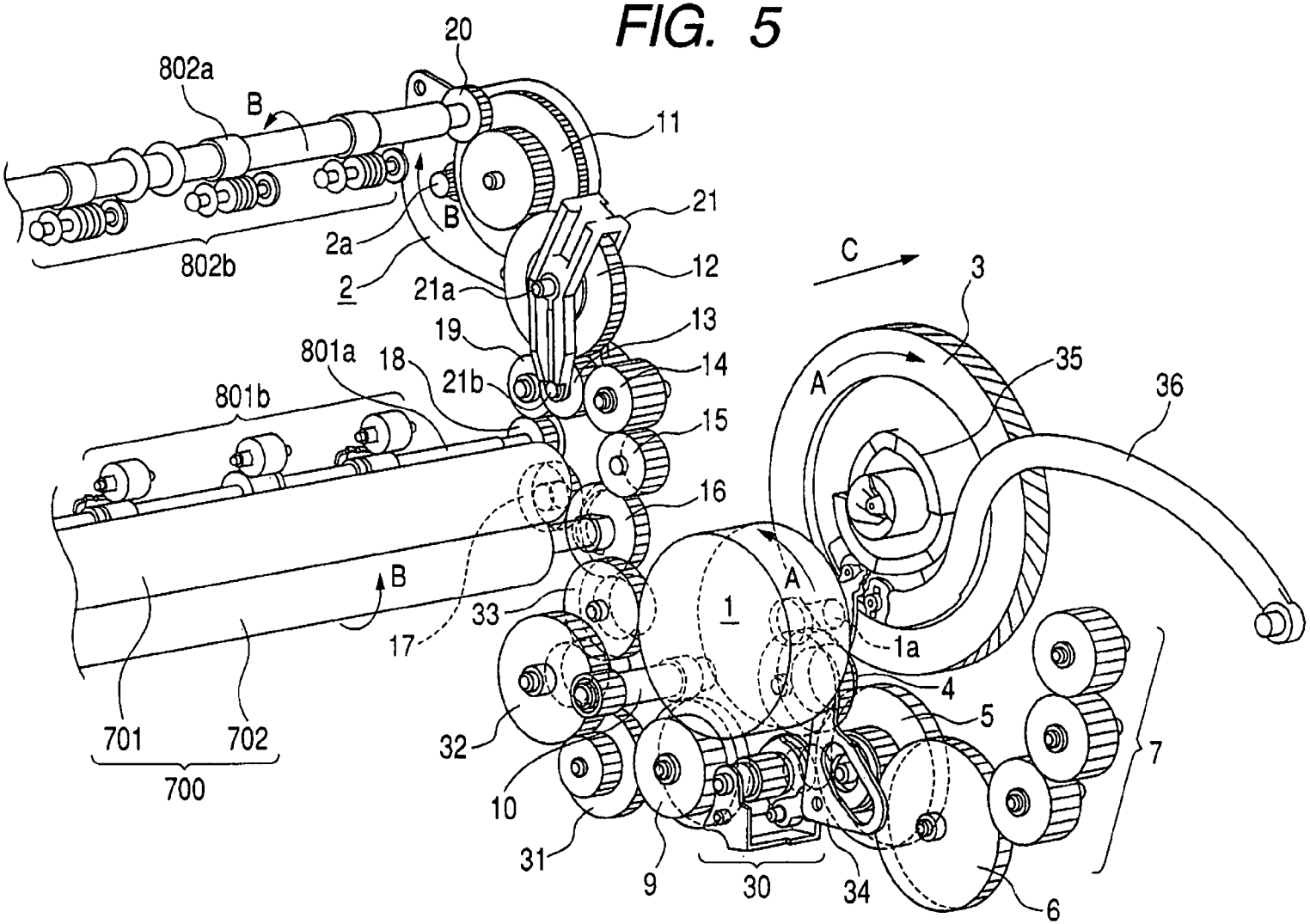
FIG. 5 is a perspective view showing a drive configuration of the image forming apparatus.
Figure 6:
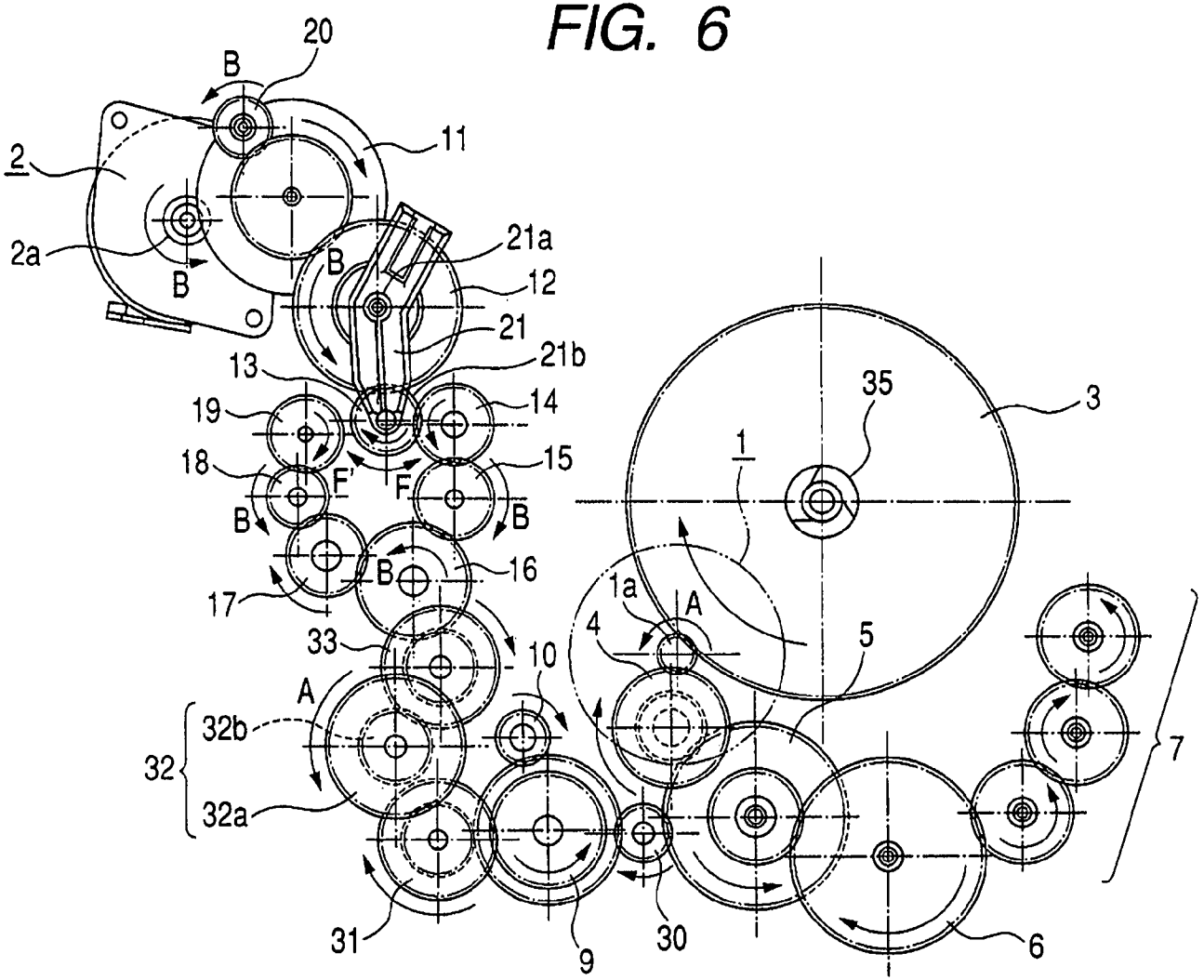
FIG. 6 is simplified sectional diagram expressing a drive configuration of the image forming apparatus.

1) Drive of an image forming apparatus of the present embodiment will be described with reference to FIGS. 5 and 6. FIG. 5 is a perspective view of a drive configuration while FIG. 6 is a simplified diagram depicting dispositions of a drive portion shown in FIG. 5. A first motor 1 is provided as first driving means for mainly driving an image forming means portion of an image forming apparatus. This first motor 1 is configured by a DC motor and drives respective types of rollers such as a photosensitive drum 401, a transfer roller 601, a paper feeding roller 104, a conveying roller 107*a*, a registration roller 108*a*, a duplex conveying roller 902*a*, a paper refeeding roller 903*a* and the like that are related to image forming operation having been described in the above described FIG. 1.

Reference numeral 2 denotes a second motor as second driving means for mainly driving the fixing apparatus 700. Further in particular, this second motor 2 is configured by a stepping motor (pulse motor) and drives a pressure roller 702 of the fixing apparatus 700, an intermediate discharging roller 801*a*, a discharging roller 802*a* and the like.

A pinion gear 1*a* is provided to be attached to the motor shaft of the above described first motor 1. The drive of this pinion gear 1*a* is transmitted to a drum gear 3 of driving the photosensitive drum 401. In addition, the drive of the pinion gear 1*a* is transmitted to a train of gears of a gear 4 of driving the paper feeding roller 104, a gear 5 of driving the conveying roller 107*a*, a gear 6 of driving the registration roller 108*a* and a gear 7 of transmitting a drive to the paper refeeding roller 903*a*. In addition, the drive of the pinion gear 1*a* is transmitted to a train of gears of a gear 5, a gear 9 and a gear 10 through a drive releasing unit 30 of transmitting/releasing a drive to the duplex conveying roller 902*a*. The respective gears of the above described train of gears are disposed so as to be capable of rotating respectively on gear shafts as centers. Drive transmission to the duplex conveying roller 902*a* being a part of the duplex unit is implemented through the gear 10.

A pinion gear 2*a* is attached to the motor shaft of the second motor 2. A drive of this pinion gear 2*a* is transmitted to a discharging roller gear 20 attached to the discharging roller 802*a* through the gear 11. In addition, the drive of the pinion gear 2*a* is transmitted to a pressure roller gear 16 attached to the pressure roller 702 of the fixing apparatus 700 through a train of gears of the gear 11, the gear 12, the swing gear 13 and the gear 15. In addition, the drive of the pinion gear 2*a* is transmitted from the above described pressure roller gear 16 through the gear 17 to an intermediate discharging roller gear 18 attached to the intermediate discharging roller 801*a*. In addition, the drive of the pinion gear 2*a* is transmitted to through the above described swing gear 13 and the gear 19 to the intermediate discharging roller gear 18 attached to the intermediate discharging roller 801*a*. The respective gears of the above described train of gears are disposed so as to be capable of rotating respectively on gear shafts as centers.

Here, the above described swing gear 13 is installed so as to be capable of rotating on a center shaft 21*b* attached to a swing holder 21 and the swing holder 21 is installed so as to be capable of rotating on the same shaft as the rotation center shaft of the gear 12 and thereby the above described swing gear 13 is made capable of transmitting the drive selectively onto any one of the gear 14 and the gear 19.

Here, in the span from the first motor 1 to the fixing unit, a gear 31 for transmitting driving force from the first motor 1 to the pressure roller gear 16, a one-way multiple gear (hereinafter to be referred to as one-way W gear) 32 and a gear 33 are disposed rotatably between the above described gear 9 and pressure roller gear 16. Here, the one-way W gear 32 has a gear 32*a*, a gear 32*b* and an internal clutch mechanism shown in Japanese Patent Application Laid-Open No. 2004-019757, and only in the case where the gear 32*a* rotates in the direction of the arrow A shown in FIG. 6, the gear 32*b* also rotates in synchronization in the same direction, but in the case where the gear 32*a* rotates in the opposite direction to the arrow A, the gear 32*b* is configured so that the driving force transmission with the gear 32*a* is cut off. This one-way W gear 32 is driving force transmission discontinuing means having a function of discontinuing driving force transmission from the first motor to the fixing unit.

Here, the internal clutch mechanism as described above is employed, but another clutch mechanism in use of one-way bearing and the like may be employed.

The fixing unit of the present embodiment is started by the first motor 1 and thereafter is driven by the second motor 2, which will be described later though. In order to implement such control, the one-way W gear (driving force transmission discontinuing means) 32 is a necessary item.

Figure 7A:
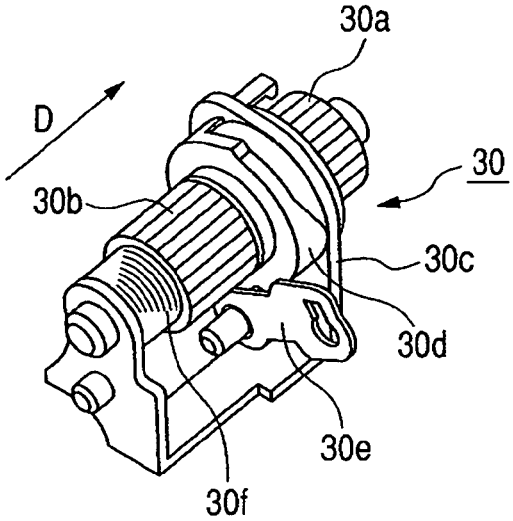
FIG. 7A shows a perspective view showing a state of a drive releasing unit at the time of drive transmission.
Figure 7B:
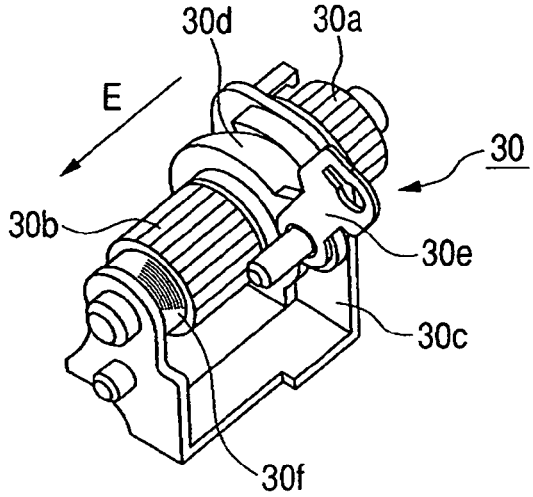
FIG. 7B shows a perspective view showing a state of a drive releasing unit at the time of drive release.

2) Here, with reference to FIG. 7, a configuration of the above described drive releasing unit 30 will be described. The drive releasing unit 30 is to discontinue drive transmission from the first motor 1 to the gear 9 in cooperation with the door member 804 of the main body of the image forming apparatus 200 when it is kept opened up. FIG. 7A is a perspective view showing a state of a drive releasing unit 30 in a state of the time of drive transmission, FIG. 7B is a perspective view showing a state of a drive releasing unit 30 in a state of at the time of drive transmission release and FIG. 7C is an exploded perspective view showing a configuration of the drive releasing unit 30.

Figure 7C:
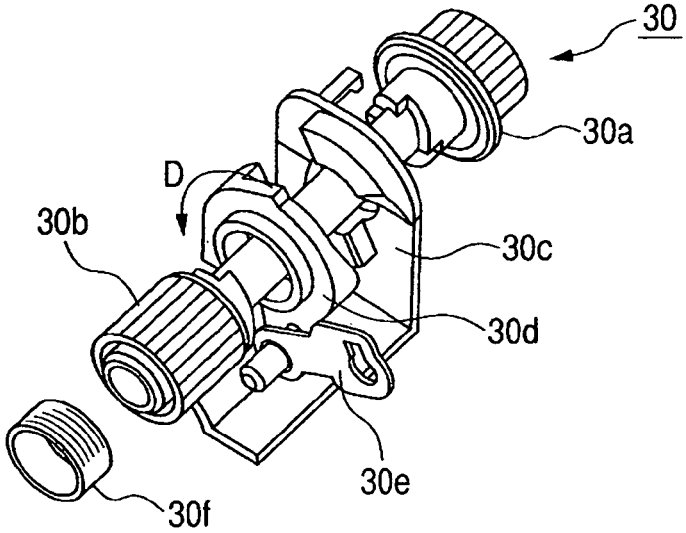
FIG. 7C is an exploded perspective view showing the drive releasing unit subject to explosion.

As shown in FIG. 7C, the drive releasing unit 30 consists of an input gear 30*a*, an output gear 30*b*, a drive releasing base 30*c*, a cam 30*d*, a link member 30*e* and a spring 30*f*. The link member 30*e* is linked to a drive releasing arm 34 that operates in cooperation with the door member 804. In addition, the input gear 30*a* is engaged with the gear 5 and the output gear 30*b* is engaged with the gear 9. As shown in FIG. 7A, the output gear 30*b* at the time of drive transmission (that is, when the door member 804 is in a closed state) is always pressed in the direction of the input gear 30*a* by the spring 30*f* and the mutual terminal shapes of the gears make it possible to transmit driving force of rotation from the input gear 30*a* in the only one direction to the output gear 30*b*. In addition, in the case where the link member 30*e* is located as shown in FIG. 7B, (in case of having rotated in the direction of the arrow D in FIG. 7C), that is, the door member 804 is opened up, due to the shape of cam installed on a surface where the drive releasing base 30*c* and the cam 30*d* are in contact with each other, the cam 30*d* moves in such a direction to depart from the input gear 30*a* (in the direction of an arrow E in FIG. 7B) together with the output gear 30*b* and cancels drive transmission between the input gear 30*a* and the output gear 30*b*.

Figure 8:
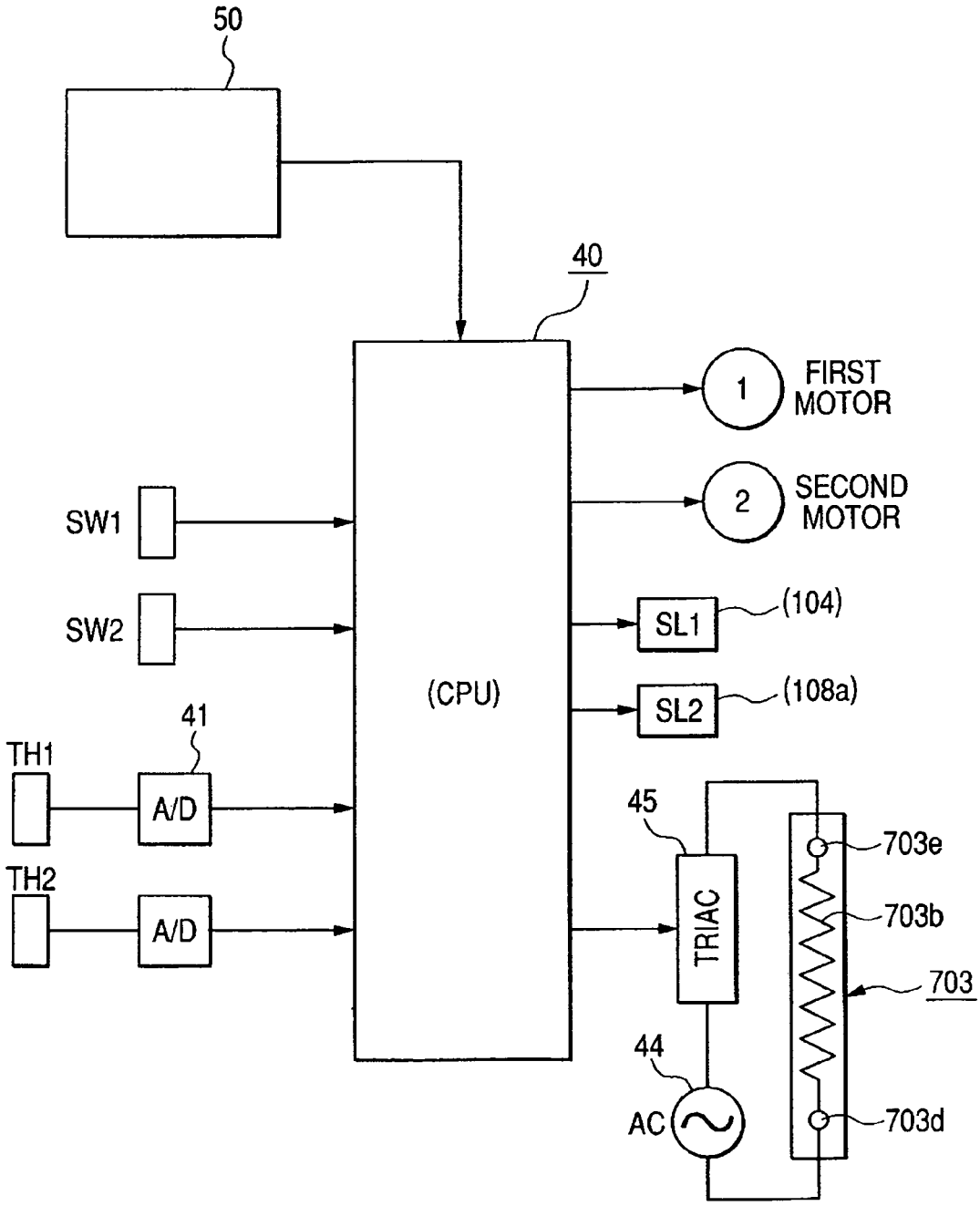
FIG. 8 is a block diagram of a control system of the image forming apparatus.

3) An operation mode of an apparatus in case of printing on one side of recording paper will be described below. FIG. 8 is a block diagram of a control system of the image forming apparatus. A control portion (CPU) 40 starts a first motor 1 based on image signals transmitted from a host computer 50 to rotary drive a pinion gear 1*a* in the direction of an arrow A in FIGS. 5 and 6. Thereby, in FIGS. 1, 5 and 6, a photosensitive drum 401, a transfer roller 601, a paper feeding roller 104, a conveying roller 107*a*, a registration roller 108*a*, a duplex conveying roller 902*a*, a paper refeeding roller 903*a* rotate in the direction of the arrow A.

The control portion 40 controls solenoids SL1 and SL2 to execute rotation start of the paper feeding roller 104 and the registration roller 108*a* at predetermined timing.

The control portion 40 controls a charging roller 402, a laser scanner unit 500 and a developing apparatus 403 in accordance with predetermined image forming sequence control to execute a toner image forming operation onto the rotating photosensitive drum 401 surface.

In addition, when the first motor 1 is started, rotary force of the pinion gear 1*a* is transferred to a one-way W gear 32 through a gear 4, a gear 5, a drive releasing unit 30, a gear 9 and a gear 31 so as to rotate the gear 32*a* of the one-way W gear 32 in the direction of the arrow A in FIG. 6. Since arrow A direction is the locking direction of an internal clutch mechanism of the one-way W gear 32, the gear 32*b* rotates in the arrow A direction likewise so as to rotate a pressure roller gear 16 via the gear 33 in the direction of an arrow B. That is, such a state will take place that a pressure roller 702 of a fixing unit 700 has been driven by the first motor 1 being the first driving means for driving mainly image forming means.

In addition, as shown in FIG. 6, the gear 4, the gear 5, the gear 9, the gear 31, the one-way W gear 32 and the gear 33 are configured by a multiple gear (W gear). A train of those gears makes a train of reduction gears so that, deriving a large reduction proportion, shaft torque of the first motor 1 required for rotating the pressure roller 702 can be restrained low. Here, the rotation speed of the pressure roller 702 by the first motor 1 is set to around one-fifth of the pressure roller rotation speed by the later described second motor 2 (at the time of paper feeding of recording paper). The train of reduction gears for driving the fixing unit is provided on a drive force transmission rout that is branched from midway on drive force transmission route from the first motor 1 to the duplex unit to reach the fixing unit.

FIGS. 9A, 9B, 9C and 9D are timing charts of describing apparatus control that the control portion 40 implements. Numeral t1 denotes a start-up time. As shown the timing chart FIG. 9B, at the start-up time t1 of the first motor 1, drive torque of the fixing unit 700 indicates that of the maximum T1. This is largely related, as having been described above, to viscosity of heat-resistant grease stuck between the heater 703 and the fixing film 705, deformation of the pressure roller 702 and the like. However, as having been described above, rotation with reduction gears up to one-fifth of the case at the time of paper feeding of the recording paper can make load applied to the first motor 1 to get smaller to an extreme extent so as to enable the fixing unit 700 to start with the first motor 1.

Figure 9A:
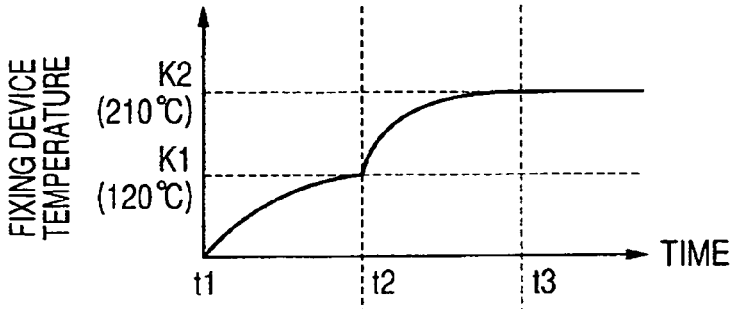
FIG. 9A is a timing chart describing drive timing at the time of starting of the first motor and the second motor and control of temperature of a fixing device of the image forming apparatus.
Figure 9B:
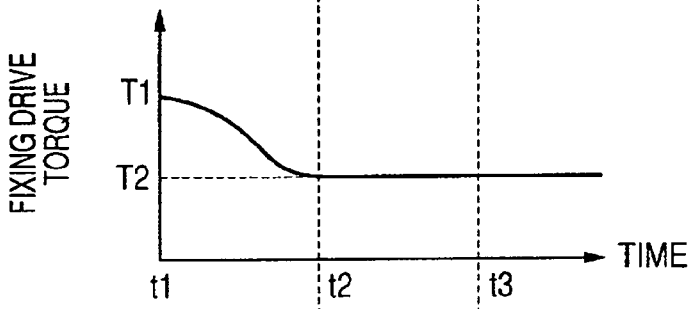
FIG. 9B is a timing chart describing drive timing at the time of starting of the first motor and the second motor and control of fixing drive torque of the image forming apparatus.
Figure 9C:
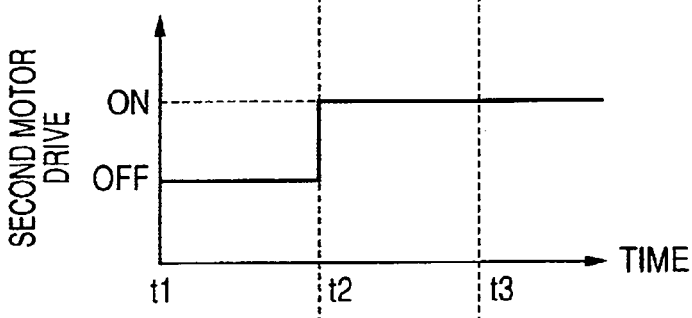
FIG. 9C is a timing chart describing drive timing of the first motor and the second motor of the image forming apparatus.
Figure 9D:
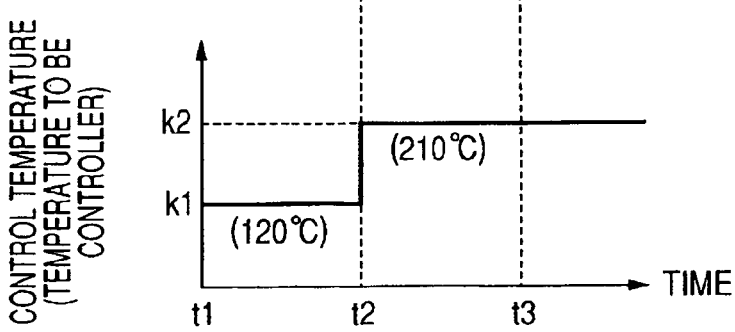
FIG. 9D is a timing chart describing drive timing at the time of starting of the first motor and the second motor and control of temperature of a fixing device of the image forming apparatus.

In addition, as shown in the timing chart FIG. 9D, the control portion 40 controls temperature conditioning on the fixing unit 700 at a first controlled temperature (temperature-conditioned temperature) k1 (for example, to be set to 120° C. here) at the same time as the time of start t1 of the first motor 1 (that is, the heater is controlled to derive the heater temperature of the temperature k1). Thereby, melting of the heat-resistant grease between the above described heater 703 and fixing film 705 is encouraged so as to plan reduction in fixing drive torque and store in the fixing unit 700 in advance a part of a heat quantity required for the subsequent paper feeding of the recording paper.

In addition, here, input power of the heater 703 at the time of temperature conditioning at the first controlled temperature k1 is set to the half of the second controlled temperature k2 (controlled temperature at the time of fixing processing) at the time of temperature conditioning. Thereby, should any failure occur in the first motor 1 and the motor no longer operate, the fixing unit 700 or the main body of the apparatus can be prevented from being damaged deadly.

Moreover, the control portion 40 starts driving the second motor 2 as shown in the timing chart FIG. 9C at the time point t2 when the fixing device temperature (heater temperature) has reached a predetermined temperature k1 (for example, 120° C. here) as shown in the timing chart FIG. 9A.

Here, in the present embodiment, the starting time point t2 of the second motor 2 was set to the time point when the fixing device temperature has reached k1, but the trigger for starting the second motor will not be limited to this method. For example, the time period required for the motor torque to reach predetermined torque T2 may be confirmed in experiments in advance so that the time period t2-t1 from the starting time point t1 of the first motor 1 to the starting time point t2 of the second motor 2 is set in advance. In addition, a control method of making them selectable based on respective conditions selected from the group consisting of environments and the like will do as well. The predetermined time period t2-t1 is set to cover the span from the image forming means starting time point to, at least, the time point when the recording media are guided into the fixing apparatus.

As shown in the timing charts FIGS. 9B and 9C, starting the second motor 2 after the fixing drive torque has sufficiently decreased, failure such as loss of synchronism due to overload and the like of the second motor 2 can be prevented.

In addition, the control portion 40 controls temperature conditioning on the fixing unit 700 at a second controlled temperature k2 (for example, to be set to 210° C. here) at the same time of starting the second motor 2 and thereby can secure stable fixing performance.

In addition, after at least one sheet of recording paper to the fixing unit 700 has undergone paper feeding, a third controlled temperature k3, a fourth controlled temperature k4 and the like that are appropriate may be set in accordance with an operation environment, a paper feeding state and the like.

4) On the other hand, inside the paper feeding cassette 101, recording paper S disposed on an intermediate plate 102 is pressed by the paper feeding roller 104 with force of the coil spring 103, and the solenoid SL1 is controlled by the control portion 40 at predetermined control timing so that the paper feeding roller 104 starts rotating in the arrow A direction in FIG. 6 and thereby the a number of sheets of recording paper S that are in contact to the paper feeding roller 104 and are present at the top portion are conveyed by the paper feeding roller 104. In addition, at the same time of this operation, a sheet of the recording paper S that is in contact to the paper feeding roller 104 is separated by the separating pad 105 and is further conveyed to the downstream side.

The recording papers S at the top position separated by the separating pad 105 is further conveyed to the downstream side by a pair of conveying rollers 107, strikes the nip of the pair of registration rollers 108 that is in rotation halt at the point of time to form a predetermined loop and thereby undergoes correction of the skewing state.

Thereafter, the solenoid SL2 is controlled by the control portion 40 at predetermined control timing so that the pair of registration rollers 108 starts rotation in the arrow A direction in FIG. 6, and thereby the recording paper S having undergone correction of the skewing state will be conveyed toward the transfer nip portion T.

The control portion 40 brings the front tip position of the recording paper S and emission timing of a laser scanner 500, which is the exposure light source, into synchronization based on the signal indicating the direction of the front tip of the recording paper S detected by the registration sensor SW1 located on the downstream side in the recording paper conveying direction of the pair of registration rollers 108 and starts writing an image onto the photosensitive drum 401 so that the toner image on the photosensitive drum 401 corresponds with a predetermined position on the recording paper S.

And, the toner image on the photosensitive drum 401 is transferred onto the recording paper S by the transfer roller 601 in the nip portion T and then the recording paper S is conveyed to the fixing unit 700 via the conveyance path 602.

As in the above described control, when the second motor 2 starts rotating in the arrow B direction shown in FIG. 6, drive force of the pinion gear 2*a* is transmitted to the discharging roller gear 20 through the gear 11 so that the discharging roller 802*a* rotates in the arrow B direction shown in FIG. 1.

In addition, drive force of the pinion gear 2*a* is transmitted to the pressure roller gear 16 though the gear 11, the gear 12, the swing gear 13, the gear 14 and the gear 15 so that the pressure roller 702 of the fixing unit 700 rotates in the arrow B direction in FIG. 1. Moreover, it is transmitted to the intermediate discharging roller gear 18 through the pressure roller gear 16 and the gear 17 so that the intermediate discharging roller 801*a* rotates in the arrow B direction in FIG. 1. Here, the swing holder 21 rotary moves in the arrow F direction by friction force derived by sliding on the gear 12 and, thereby, the swing gear 13 is linked to the gear 14.

As in the above described control, the control portion 40 starts, as to the fixing unit 700, temperature conditioning control, at the second controlled temperature k2 (for example, to be set to 210° C. here) so as to raise the fixing device temperature to reach the toner fixable temperature before the recording paper S enters the fixing nip portion N.

Here, the rotation speed of the pressure roller 702 by the second motor 2 is set to five times of the pressure roller rotation speed by the above described first motor 1, but it is advisable that this speed proportion is set in an optimum fashion in terms of print speed, motor specifications, fixing drive torque and the like.

Moreover, the control portion 40 is designed to variably set rotary speed of the pressure roller 702 by the above described second motor 2 based on information from the above described fixing temperature detecting means TH1, environmental temperature and moisture detecting means TH2, and information such as number of print sheets, type of the recording paper and the like so as to enable speed setting to cancel influence of change in diameter due to thermal expansion of the pressure roller 702 and the like and a stable image can be derived.

That is, in a heating apparatus of film heating system of pressure member drive system/tensionless type used as the fixing unit 700 as described above, heating of the heater 703 is accompanied by temperature rise as time goes by and, therefore, at that time, thermal expansion in the rubber portion results in increase in outer diameter. Therefore, when the pressure roller 702 is rotary driven at a constant rotation amount at the time when the pressure roller 702 is hot, the pressure roller 702 will undergo larger thermal expansion than that at the time of the low temperature so that the rotary circumferential velocity increases and the recording paper conveying speed will get fast. And in an apparatus in which the conveyance path 602 from the transfer roller 601 to reach the fixing unit 700 is set shortly, in order to make the image forming apparatus more compact, slack of the recording paper S from the transfer roller 601 to the fixing unit 700 is little and variation in the above described recording paper conveying speed in the distance from the transfer nip portion T to the fixing nip portion N results in more variable tension of the recording paper S from the transfer roller 601 to the fixing unit 700, occasionally giving rise to phenomena such as elongation and disorder of an image. In the image forming apparatus of the present example, the apparatus is configured to provide, individually, the second motor (fixing-related motor) 2 of mainly driving the fixing unit 700 and the first motor (imaging-related motor) 1 of driving the other driven portions with the image forming portion as center, to control the drive speed of the fixing-related motor 2 thereby to control to cause tension of the recording paper S from the transfer nip portion T to the fixing nip portion N not to vary so that the above described problem is planed to be solved.

Accordingly, the unfixed toner image on the recording paper S conveyed to the fixing unit 700 undergoes heating/pressing in the nip N between the film unit 701 as heating member and the pressure roller 702 as pressure member and thereby becomes an eternally fixed image and is discharged through the pair of intermediate discharging rollers 801 and piled by the pair of discharging rollers 802 onto the tray 803 outside the apparatus.

In addition, after start of the above described second motor 2, both of drive force by the second motor 2 and drive force by the first motor 1 will be applied to the pressure roller gear 16.

As described above, since difference in rotation speed is present between the both parties, such failure that the first motor 1 which normally imparts a slow speed rotates in the inverse direction and the like will occur. However, compared with rotation counts of the gear 32*b* configuring the one-way W gear inputted through the gear 33 from the pressure roller gear 16 driven by the second motor 2, since the rotation counts from the first motor 1 to the corresponding gear 32*a* is lower. That is, relative speed takes place in the inverse direction against the locking direction of the internal one-way clutch mechanism of the one-way W gear 32, the mutual drive force will not interfere. That is, when the second motor 2 starts, the drive force of the first motor 1 is configured not to be transmitted to the pressure roller gear 16. Accordingly, even if the above described difference in rotation speed occurs, no failure will occur to the image forming means and fixing means and related rollers.

5) Next, an operation mode of an apparatus in case of printing on the both sides of recording paper will be described. Likewise the above described one-side print operation, after the recording paper S is fed by the paper feeding roller 104, the second motor 2, the pressure roller gear 16, the intermediate discharging roller gear 18 and the discharging roller gear 20 are rotating in the direction shown by the arrow B in FIG. 6. At that time, the pressure roller 702, the intermediate discharging roller 801*a* and the discharging roller 802*a* also rotate in the same direction to convey the recording paper S.

The trailing edge of the recording paper is detected by the sheet sensor SW2 of detecting that the trailing edge of the recording paper S has reached the location where it gets through out of the nip formed by the intermediate discharging roller 801*a* and the pinch roller 801*b*, and then the control portion 40 receives the signal and causes the second motor 2 to rotate in the inverse direction against the arrow B having been shown in FIG. 6. With the inverse rotation of this second motor 2, the discharging roller gear 20, that is, the discharging roller 802*a*, starts inverse rotation so as to guide the recording paper S to the reverse conveyance path 900 and the duplex conveyance path 901.

Here, the swing holder 21 rotary moves in the arrow F' direction shown in FIG. 6 by friction force derived by sliding on the gear 12 and thereby, the swing gear 13 is linked to the gear 19. Due to this link, the pressure roller gear 16 rotates in the same direction as the rotating direction B shown in FIG. 6 through the intermediate discharging roller gear 18 on the lower step thereof and moreover the gear 17. Consequently, the pressure roller 702 to be made incapable of inverse rotation due to a reason such as damage to the fixing film 705 of the fixing unit 700 and the like will always become rotatable only in one direction (in the arrow B direction shown in FIG. 6) in spite of inverse rotary drive of the second motor 2. That is, since provision of the swing gear 13 causes the pressure roller 702 to rotate always in the same direction regardless the rotating direction of the second motor 2, damages and the like to the fixing film 705 can be restrained.

With the inverse rotation of the above described discharging roller 802*a*, the recording paper S is conveyed downward along the reverse conveyance path 900 and reversed so as to reach the pair of duplex paper refeeding rollers 903 through the duplex conveyance path 901 and the pair of duplex conveying rollers 902. And, in the likewise mode as image forming was implemented on the first side, the second side undergoes image transfer with the transfer roller 601 and is conveyed to the fixing unit 700 through the conveyance path 602.

The control portion 40 brings the second motor 2 into reverse driving (in the arrow B direction shown in FIG. 6) again before the above described recording paper S having undergone transfer of the unfixed toner image onto the second side reaches the fixing unit 700. Thereby the unfixed toner image on the recording paper S having been conveyed to the fixing unit 700 likewise at the time of one-side image fixing undergoes heating/pressing in the nip N between the film unit 701 of the fixing unit 700 and the pressure roller 702 and thereby becomes an eternally fixed image and is discharged through the pair of intermediate discharging rollers 801 and piled by the pair of discharging rollers 802 onto the tray 803 outside the apparatus.

6) Next, actions of respective portions except the printing action will be described. Described below are actions of respective portions at the time of processing on jam in the case where the recording paper S1 that is in halt still being held sandwiched in the fixing nip portion N as shown in FIG. 2.

6-1) Processing with Regard to the Downstream Side of the Fixing Unit

As shown in FIG. 2, in case of trying to take out the recording paper S1, that is in halt still being held sandwiched in the fixing nip portion N, to the downstream side of the fixing unit (in the arrow G direction), the recording paper S1 itself is pulled or otherwise a not shown jam processing dial (a knob allowing manual rotation of the pressure roller 702) is operated and thereby the pressure roller 702 is rotated to enable discharge of the recording paper S1.

This operation causes the pressure roller gear 16 to rotate in the arrow B direction shown in FIG. 6, and therefore rotation is transmitted in the respective directions of the first motor 1 and the second motor 2. However, the gear 14 and the gear 19 rotate in the arrow B direction as shown in FIG. 6, and therefore even if a swing gear 13 has been coupled to any one of them, it will be kicked out from any one of the gears so as to turn together with the swing holder 21 in unity to a neutral position where coupling to neither of the gear 14 or the gear 19 takes place. Accordingly, drive transmission to the second motor 2 is disconnected. Likewise since the gear 32*b* of the one-way W gear 32 rotates in the idling direction of the interior one-way mechanism, drive transmission to the first motor 1 is disconnected. That will make it possible to pull out the recording paper S1 with such light force as not to damage the recording paper S1. In addition, operation of jam processing dial will become feasible with light force. In addition, jam processing action will not result in causing the first motor 1 and the second motor 2 to rotate, enabling prevention of damage to motors in advance.

6-2) Processing with Regard to the Upstream Side of the Fixing Unit

As shown in FIG. 2, in case of trying to take out to the upstream side of the fixing unit (in the arrow H direction) the recording paper S1 that is stayed and bound in the fixing nip portion N, at first the door member 804 is opened up so that the process unit 400 having the photosensitive drum 401 is taken out outside the apparatus. In this case, the door member 804 is opened up to cause the door arm 36, that is rotatably installed in the door member 804, to let the drum drive releasing ring 35 shown in FIG. 5 to rotate. Thereby mutual positional relationship between the shape of the cam not shown in the drawing installed in the main body side and the shape of the cam of the drum drive releasing ring will change to move the drum gear 3 in the arrow C direction shown in FIG. 5 and coupling to the photosensitive drum 401 is canceled, enabling the above described process unit 400 to be taken out of the apparatus.

In addition, at the time of opening up the door member 804, rotation of the above described drum drive releasing ring 35 causes the cam 30*d* of the drive releasing unit 30 to rotary move by the drive releasing arm 34 and the link member 30*e*, and thereby as described above, drive force transmission between the gear 30*a* and the gear 30*b* inside the drive releasing unit is disconnected.

Accordingly, even if the recording paper S1 in the arrow H direction shown in FIG. 2 is pulled and thereby the pressure roller 702 of the fixing unit 700 to rotate reversely, rotation transmission of the pressure roller gear 16 toward the first motor 1 is shut off inside the drive releasing unit 30.

In addition, the drive force transmitted to the gear 14 and the gear 19 with rotation of the pressure roller 702 derived by jam processing will be transmitted to the second motor 2 in the case where any one of the gear 14 and the gear 19 is coupled to the swing gear 13. However, at the halt time of the apparatus prior to jam processing, the swing gear 13 moves to a position that imposes no engagement with any of the gear 14 and the gear 19. Because, at the time of halt of the apparatus, the first motor 1 and the second motor 2 are deprived of power supply almost at the same time, and while the second motor 2 configured by a stepping motor generally halts instantly having been derived of power supply, the first motor 1 configured by a DC motor is influenced by rotor's inertia to keep on rotating even after having been deprived of power supply. Thereby, time required for causing the first motor 1 to halt gets longer than in case of the second motor 2. Accordingly, the drive force from the first motor 1 reaches the gear 14 and the gear 19 through the pressure roller gear 16 to cause them to rotate in the arrow B direction shown in FIG. 6 respectively.

Thereby, also in the case where the swing gear 13 has been coupled to any one of gears of the gear 14 or the gear 19 immediately prior to a halt, due to inertia of the rotor of the first motor 1, the swing gear 13 will be kicked out of the coupled state with the gear so as to turn together with the swing holder 21 in unity to a neutral position where coupling to neither of the gear 14 or the gear 19 takes place.

Accordingly, at the time of a halt of the apparatus, the swing gear 13 is not in a coupled state with any one of the gear 14 and the gear 19. That is, in a halt state of the apparatus, no drive force will be transmitted upstream from the swing gear.

As having been described above, drive force accompanied by inverse rotation of the pressure roller 702 generated at the time of pulling the recording paper S1 sandwiched in the fixing nip portion N in the inverse direction H to the paper feeding direction will not be transmitted from the gear 30*b* to the gear 30*a* since the drive releasing unit 30 is in a drive transmission releasing state, thus failure such as damage to the first motor 1 will become preventable from occurring. In addition, since the swing gear 13 is in a neutral position, pulling force will be required less at the time of pulling out the recording paper S from the fixing nip portion N at the time of the above described jam processing so that damages to recording paper and the like can be prevented.

Description herein has been made on an apparatus capable of duplex printing to exemplify the image forming apparatus, but the present invention is also applicable to an apparatus capable of only one-side printing.

Description herein has been made on a laser beam printer to exemplify the image forming apparatus, but the present invention will not be limited to a laser printer.

As having been described above, the image forming apparatus of the present embodiment has a fixing unit that is started by the first motor 1 of driving the image bearing member 401 and thereafter is driven by the second motor 2, and therefore can save costs allocated to the second motor 2.

Second Embodiment

Second Embodiment of the image forming apparatus related to the present invention will be described below. Here, only difference from first Embodiment will be described and the others will be omitted.

Figure 10:
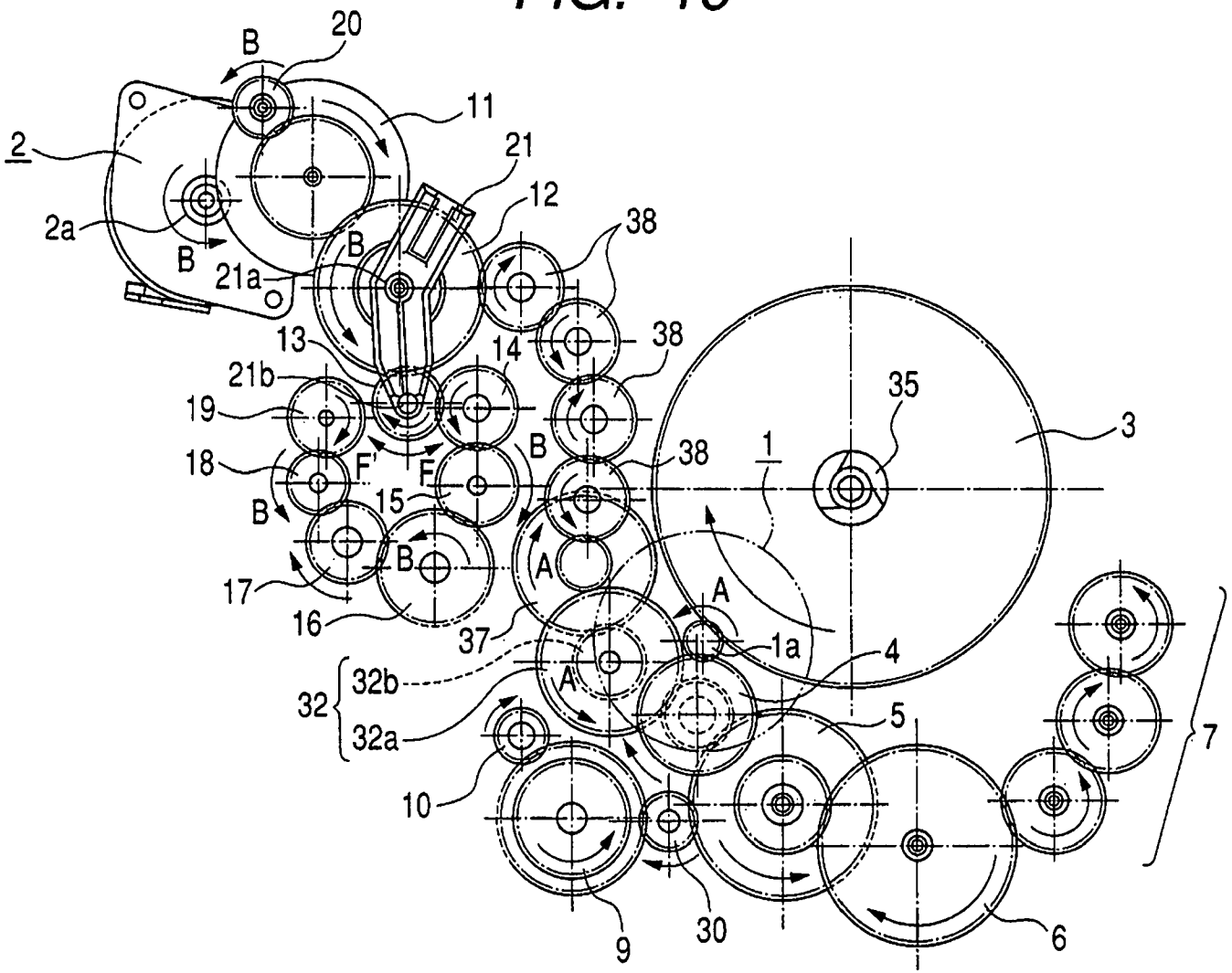
FIG. 10 is a simplified sectional view showing a drive configuration in the image forming apparatus related to a second embodiment.

In FIG. 10, reference numerals 37 and 38 denote a train of gears of transmitting drive from a first motor 1 being first driving means.

The driving force of the pinion gear 1*a* attached to the first motor 1 is configured to be transmitted from the gear 4, the above described gear 37 and a plurality of gears 38 and inputted to the gear 12. Generally, the fixing unit 700 having the pressure roller 702 is configured in many cases to be removable from the main body of an image forming apparatus together with the fixing unit 700 in unity in consideration of, for example, change of fixing roller. In the present embodiment, as well, the likewise configuration is taken (not shown in the drawing). The above described configuration will bring the pressure roller gear 16 or the gear installed in the fixing unit 700 capable of transmitting a drive to the pressure roller gear 16 and the gear installed in the main body of the image forming apparatus (the gear 19 in the present embodiment) into engagement. Accordingly, as the number of gears installed in the main body of the image forming apparatus that are brought into engagement with the above described pressure roller gear 16 or the above described gear 19 increases, high accuracy in positioning is required in a lot of sites in the installation position of the fixing unit 700, which will make it impossible to secure a proper backlash.

However, as shown in the present embodiment, inputting the drive from the first motor 1 to an idler gear 12 coaxially rotatable with the swing holder 21, the amounts of gears engaged with the pressure roller gear 16 can be configured to be small. Here, the gear 37 and the gear 38 are provided in the same main body of the image forming apparatus as the one where the gear 12 is located so as to secure a proper backlash without difficulty. In addition, since the gear 19 is engaged with the swing gear 13, a not shown striking configuration capable of securing a proper position is caused to regulate turning of the swing holder 21 and thereby a proper backlash can be secured without difficulty. Accordingly, in the present embodiment, securing accuracy in position of the pressure roller gear 16 only on the idler gear 15 installed in the main body of the image forming apparatus, the fixing unit 700 can realize inter-gear backlashes comparatively easily with an inexpensive configuration. In addition, thereby, stable image forming will become feasible.

Third Embodiment

Figure 11:
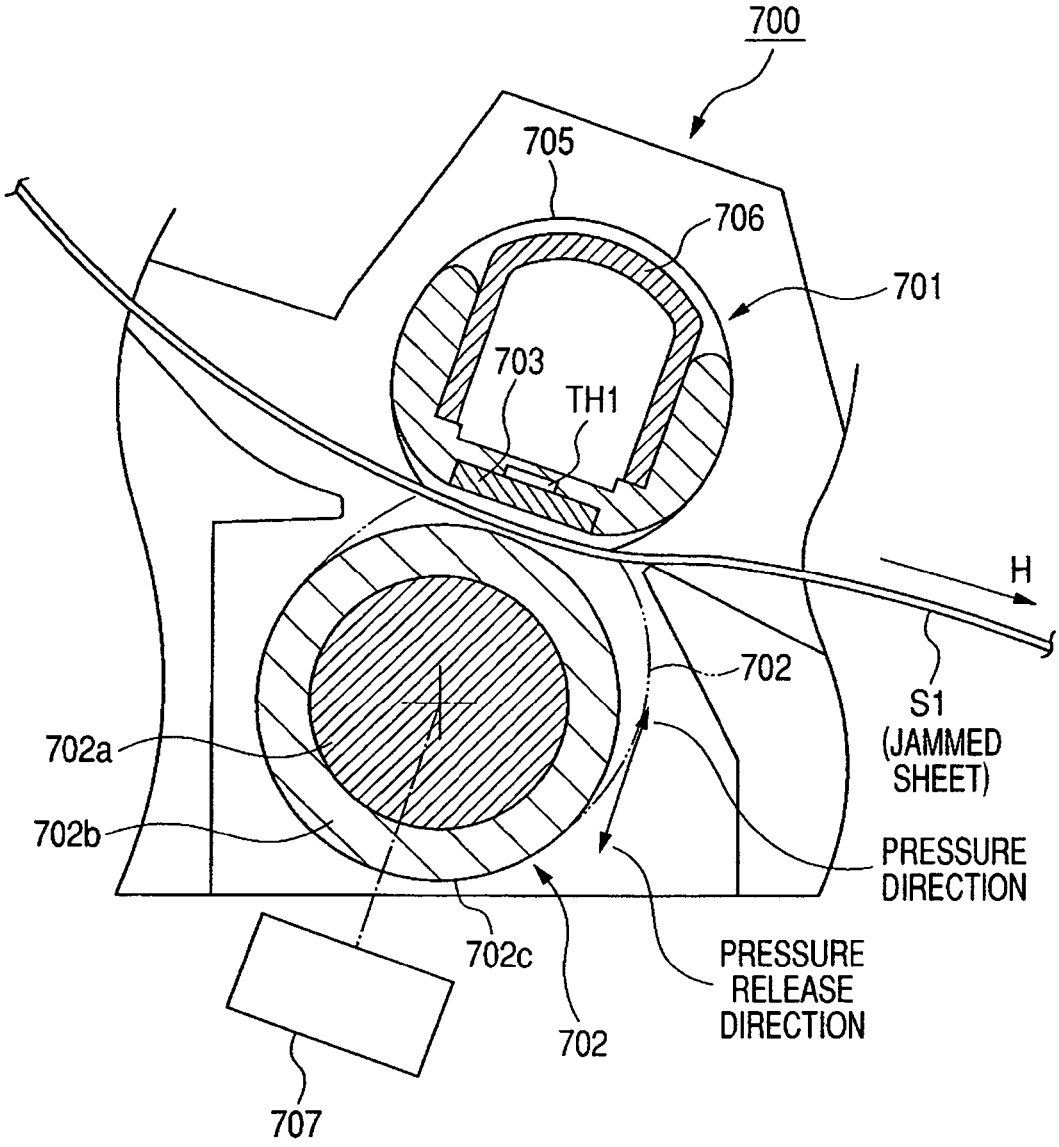
FIG. 11 is a descriptive diagram of a fixing nip pressure releasing mechanism in a third embodiment.

In first and second Embodiments, the drive releasing unit 30 was caused to intervene between first motor 1 and the fixing unit 700 so as to enable prevention of damage to the first motor 1 at the time of jam processing as well as damage to recording paper due to enormous pulling torque and the like, and jam processing with light operation force, but instead, as in FIG. 11, presence of the fixing nip pressure releasing mechanism 707 to be operated manually or in cooperation with open/close actions of the door member 804 can give rise to likewise effects. Of course, the both of them may be adopted.

The fixing nip pressure releasing mechanism 707 can be configured by a cam mechanism, a lever mechanism and the like that, for example, pushes down the pressure roller 702 manually or in cooperation with an opening action of the door member 804 against welding force of pressurizing means (not shown in the drawing) so as to undergo pressure welding to the film unit 701 as heating member and lets the fixing nip pressure into a released state. It can be configured by means for releasing welding force of the above described pressurizing means.

Thus, at least one of the drive releasing unit 30 of preventing the drive in the inverse rotating direction of the first driving means from being transmitted from the fixing apparatus 700 side to the first driving means 1 side or the nip releasing mechanism 707 of releasing the nip N of the heating member 701 and the pressure member 702 of the fixing apparatus 700 is present so that drive force of rotation member inside the fixing apparatus that takes place in case of pulling out the recording media S remaining inside the nip N from the upstream side of the fixing apparatus 700 in the recording media conveyance direction will not be transmitted to the first driving means 1 or in case of pulling out the recording paper S with nip release, drive force will not work on the rotating member inside the fixing apparatus, and therefore damage to the first driving means 1 and damage to the recording paper S due to enormous pulling torque can be prevented and thus, jam processing will become feasible with light operation force and image forming apparatus that is excellent in usability and highly reliable will become providable.

In addition, the orifice 200*a* for taking out the recording media S at the time of recording media jam processing and the door member 804 for opening/closing the orifice 200*a* is present, and in the case where the fixing nip releasing mechanism 707 operates in cooperation with opening/closing operations of the door member 804, thereby, pull out the recording media S1 remaining inside the fixing nip portion N from the upstream side, and the door member 804 is opened to release the drive force or the nip pressure so that a user will not be required for troublesome operations but an image forming apparatus allowing simple and sure jam processing will become providable.

In the above described first, second and third Embodiments, the fixing apparatus 700 will not be limited to a heating apparatus in a film heating system of a pressure member drive system/tensionless type but may be a fixing apparatus of heat roller system or a fixing apparatus of pressure roller system or the like. The heating apparatus of film heating system may be a heating apparatus of a type providing film with tension.

The present invention will not be confined to the above described embodiments, but will include variations falling within the technological spirit.

This application claims priority from Japanese Patent Application No. 2005-042140 filed on Feb. 18, 2005, which is hereby incorporated by reference herein.

What is claimed is:

1. An image forming apparatus comprising:

an image bearing member;

a first motor for driving said image bearing member;

a fixing unit which fixes an image transferred from said image bearing member to a recording material onto the recording material, said fixing unit having a roller to form a fixing nip portion that pinches and conveys the recording material;

a second motor for driving the roller, a duplex unit for reversing sides of the recording material after the recording material passes through said fixing unit and conveying it again to said image bearing member, said duplex unit driven by said first motor; and a train of reduction gears for transmitting drive force from said first motor to said fixing unit, wherein a drive force transmission route is branched midway from said first motor to said duplex unit, and said train of reduction gears is provided on the drive force transmission route between the branched point and said fixing unit, wherein said first motor starts driving the roller from a condition in which the roller is stopped and then said second motor drives the roller, and wherein said second motor drives said roller while said fixing unit fixes the image.

2. The image forming apparatus according to claim 1, wherein said second motor is started up at a time after said first motor is started up.

3. The image forming apparatus according to claim 2, wherein said second motor is started up at a time when said fixing unit reaches a predetermined temperature.

4. The image forming apparatus according to claim 2, wherein said second motor is started up at a time when a predetermined time period elapses after said first motor is started up.

5. The image forming apparatus according to claim 1, further comprising drive force transmission disconnecting means having a function of disconnecting, after said second motor is started up, drive force transmission from said first motor to said fixing unit.

6. The image forming apparatus according to claim 5, wherein said drive force transmission disconnecting means are a one-way clutch.

7. The image forming apparatus according to claim 1, wherein said first motor is a DC motor and said second motor is a pulse motor.

8. The image forming apparatus according to claim 1, wherein said fixing unit includes:

a flexible sleeve; and a heater in contact with an inner circumference surface of said flexible sleeve, wherein the fixing nip portion is formed by said roller with said heater through said flexible sleeve.

* * * * *